US010005300B2

(12) United States Patent
Ishikawa et al.

(10) Patent No.: US 10,005,300 B2
(45) Date of Patent: Jun. 26, 2018

(54) PRINTER APPARATUS

(71) Applicant: FUJITSU COMPONENT LIMITED, Tokyo (JP)

(72) Inventors: Tetsuhiro Ishikawa, Tokyo (JP); Sumio Watanabe, Tokyo (JP); Yukihiro Mori, Tokyo (JP); Masahiro Tsuchiya, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days. days.

(21) Appl. No.: 15/309,498

(22) PCT Filed: May 26, 2015

(86) PCT No.: PCT/JP2015/065000
§ 371 (c)(1),
(2) Date: Nov. 8, 2016

(87) PCT Pub. No.: WO2015/182573
PCT Pub. Date: Dec. 3, 2015

(65) Prior Publication Data

US 2017/0157960 A1 Jun. 8, 2017

(30) Foreign Application Priority Data

May 30, 2014 (JP) ..... 2014-113249

(51) Int. Cl.
*B41J 2/315* (2006.01)
*B41J 25/312* (2006.01)
*B41J 25/316* (2006.01)

(52) U.S. Cl.
CPC ..... *B41J 25/312* (2013.01); *B41J 25/316* (2013.01)

(58) Field of Classification Search
CPC ..... B41J 25/312
(Continued)

(56) References Cited

U.S. PATENT DOCUMENTS 5,846,003 A * 12/1998 Mori ..... B41J 25/312 400/120.17
5,876,129 A * 3/1999 Suzuki ..... B41J 3/36 347/218

(Continued)

FOREIGN PATENT DOCUMENTS

JP S57-001776 1/1982
JP H07-137315 5/1995

(Continued)

OTHER PUBLICATIONS

International Search Report dated Aug. 11, 2015.

*Primary Examiner* — Anthony Nguyen
(74) *Attorney, Agent, or Firm* — IPUSA, PLLC

(57) ABSTRACT

A printer apparatus includes a print head, a platen roller, a recording paper guide configured to guide recording paper placed between the print head and the platen roller, and a spring configured to press the print head toward a direction of the platen roller, wherein the spring has a first part and a second part, the first part being in contact with the recording paper guide, the second part having a head contact at an end thereof that is in contact with the print head, the spring exerting a restoring force in such a direction as to narrow a space between the first part and the second part.

8 Claims, 6 Drawing Sheets

(58) Field of Classification Search
USPC ..... 400/120.16
See application file for complete search history.

(56) References Cited

U.S. PATENT DOCUMENTS

| | | | | |
|---|---|---|---|---|
| 5,917,533 | A | 6/1999 | Suzuki et al. | |
| 6,145,976 | A * | 11/2000 | Suzuki | B41J 2/005 347/66 |
| 6,276,848 | B1 * | 8/2001 | Takizawa | B41J 3/36 400/120.01 |
| 6,336,760 | B2 * | 1/2002 | Mori | B41J 11/04 400/56 |
| 6,814,515 | B2 | 11/2004 | Tsuchiya et al. | |
| 7,614,809 | B2 * | 11/2009 | Kaiya | B41J 25/312 347/197 |
| 7,992,406 | B1 * | 8/2011 | Reece | F28D 5/00 62/259.4 |
| 9,186,904 | B2 * | 11/2015 | Tsuchiya | B41J 2/32 |
| 2007/0201928 | A1 | 8/2007 | Kaiya | |
| 2008/0199238 | A1 * | 8/2008 | Sawai | B41J 2/325 400/120.01 |
| 2014/0232806 | A1 | 8/2014 | Tsuchiya et al. | |

FOREIGN PATENT DOCUMENTS

| | | |
|---|---|---|
| JP | 2003-019845 | 1/2003 |
| JP | 2008-238480 | 10/2008 |
| JP | 2013-082112 | 5/2013 |
| JP | 2013-086282 | 5/2013 |

* cited by examiner

PRINTER APPARATUS

TECHNICAL FIELD

The disclosures herein relate to a printer apparatus.

BACKGROUND ART

Printers for producing sales receipts or the like are widely used in cash registers used in stores, ATMs (automatic teller machines) or CDs (cash dispensers) installed in banks, etc. In a printer for producing sales receipts or the like, a thermal head or the like prints on thermal paper serving as recording paper while the recording paper is advanced. After the recording paper is advanced a predetermined length, a cutter apparatus cuts a predetermined length of the recording paper from the rest of the paper.

Such a cutter apparatus has a fixed blade and a movable blade. The movable blade is moved toward the fixed blade to cut recording paper that is placed between the fixed blade and the movable blade.

RELATED-ART DOCUMENTS

Patent Document

[Patent Document 1] Japanese Patent Application Publication No. 2003-19845

SUMMARY OF THE INVENTION

Problem to be Solved by the Invention

In the above-noted printer apparatus that uses a thermal head or the like to print on recording paper, the recording paper is placed between the thermal head for printing and a platen roller for advancing the recording paper, and printing is performed while the thermal head is pressed against the platen roller.

Further miniaturization and cost reduction are required of such a printer apparatus.

Means to Solve the Problem

According to one aspect of the embodiments, a printer apparatus includes a print head, a platen roller, a recording paper guide configured to guide recording paper placed between the print head and the platen roller, and a spring configured to press the print head toward a direction of the platen roller, wherein the spring has a first part and a second part, the first part being in contact with the recording paper guide, the second part having a head contact at an end thereof that is in contact with the print head, the spring exerting a restoring force in such a direction as to narrow a space between the first part and the second part.

According to another aspect of the embodiments, a printer apparatus includes a frame, a platen roller supported by the frame in a rotatable manner, a print head; and a spring having a first part and a second part, and configured to press the print head against the platen roller, wherein the first part of the spring presses the print head, and the second part of the spring is fixedly positioned with respect to the frame, the print head being pressed against the platen roller by a restoring force of the spring acting in such a direction as to narrow a space between the first part and the second part.

Advantage of the Invention

According to at least one embodiment, miniaturization and cost reduction are achieved in respect of a printer apparatus using a thermal head or the like.

MODE FOR CARRYING OUT THE INVENTION

In the following, embodiments for implementing the invention will be described. The same members or the like are referred to by the same numerals, and a description thereof will be omitted.

Figure 1:
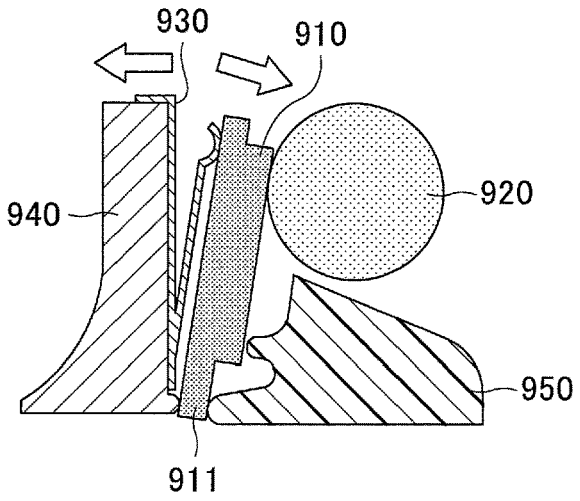
FIG. 1 is a drawing illustrating the structure of a printer apparatus.
Figure 2A:
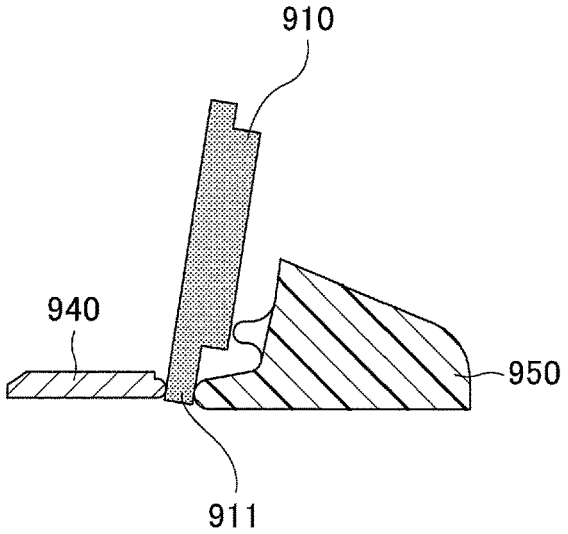
FIG. 2A is a drawing illustrating the printer apparatus.
Figure 2B:
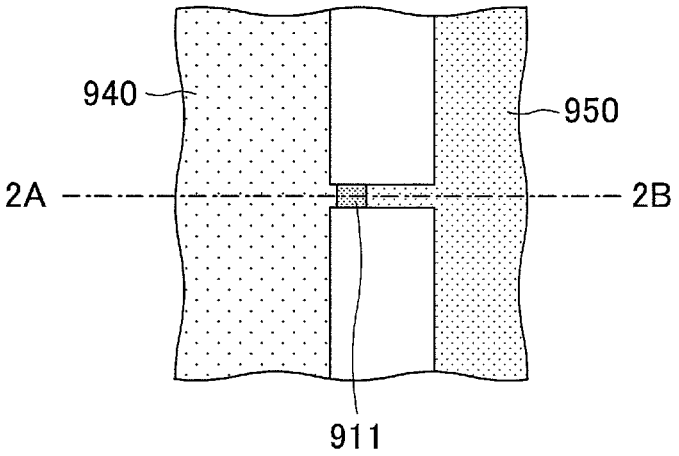
FIG. 2B is a drawing illustrating the printer apparatus.

A description will be first given of a typical printer apparatus using a thermal head by referring to FIG. 1 and FIGS. 2A and 2B. The printer apparatus illustrated in FIG. 1 includes a thermal head 910 serving as a print head for printing on recording paper and a platen roller 920 for conveying the recording paper. Recording paper (not shown) for printing, which is placed between the thermal head 910 and the platen roller 920, is advanced by the rotation of the platen roller 920 while the thermal head 910 prints on the recording paper. In such a printer apparatus, a spring 930 presses the thermal head 910 toward the platen roller 920. The spring 930 which is a head pressuring spring has a letter-V shape. The spring 930 in the installed state in the printer apparatus exerts a restoring force such that the letter-V shape widens. The spring 930, which is installed between a frame 940 and the thermal head 910, exerts a restoring force acting in the direction in which the letter-V widens as illustrated by arrows, thereby pressing the thermal head 910 toward the platen roller 920.

In the case of being formed of metal die cast such as aluminum, the frame 940 exhibits high strength, and does not deform even when the spring 930 is placed between the frame 940 and the thermal head 910. Due to requirements for cost reduction, however, the frame 940 may be formed of resin material. In such a case, the resin material is easy to deform, so that installing the spring 930 between the frame 940 and the thermal head 910 to cause the restoring force of the spring 930 to press the frame 940 made of resin material leftward in FIG. 1 possibly deforms the frame 940. Due to such deformation, the force exerted by the spring 930 to press the thermal head 910 toward the platen roller 920 may diminish. Further, the deformation of the frame 940 may possibly destroy the printer apparatus.

The printer apparatus illustrated in FIG. 1 has a recording paper guide 950 made of resin material or the like for guiding the recording paper before entry into the space between the thermal head 910 and the platen roller 920. As illustrated in FIG. 2A, a projection 911 situated at an end (i.e., the lower end in the figure) of the thermal head 910 opposite from the side of the thermal head 910 for printing on the recording paper (not shown) is placed between the frame 940 and the recording paper guide 950. The projection 911 of the thermal head 910 serves as a rotation axis of the thermal head when the spring 930 presses the thermal head 910 toward the platen roller 920. FIG. 2B is a bottom view of the printer apparatus. FIG. 2A is a cross-sectional view taken along a dot-and-dash line 2A-2B in FIG. 2B.

First Embodiment

Figure 3:
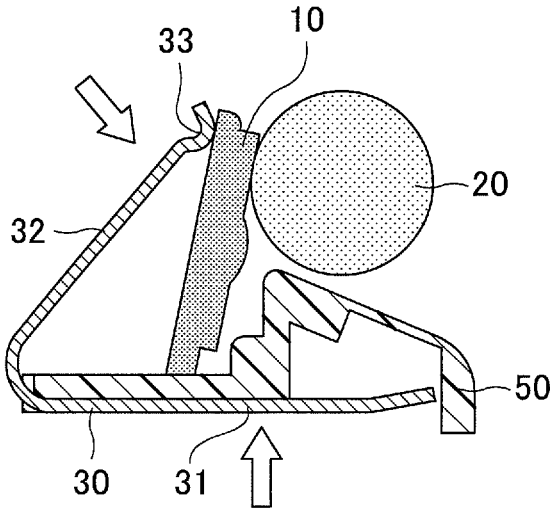
FIG. 3 is a drawing illustrating the structure of a printer apparatus of a first embodiment.

In the following, the printer apparatus of the first embodiment will be described with reference to FIG. 3 and FIGS. 4A and 4B. The printer apparatus of the present embodiment includes a thermal head 10 serving as a print head for printing on recording paper and a platen roller 20 for conveying the recording paper. Recording paper (not shown) for printing, which is placed between the thermal head 10 and the platen roller 20, is advanced by the rotation of the platen roller 20 while the thermal head 10 prints on the recording paper. In the present embodiment, the term "thermal head 10" may sometimes refer to the entire structure inclusive of a thermal head as well as a heat sink and the like attached to the thermal head.

The printer apparatus of the present embodiment has a letter-V spring 30 for pressing the thermal head 10 toward the platen roller 20. The letter-V spring 30 of the present embodiment has a first part 31 that is in contact with and fixedly mounted to a recording paper guide 50 made of resin material. The letter-V spring 30 has a second part 32, a part of which is formed into a head contact 33, which comes in contact with the back face of the thermal head 10 to press the thermal head 10 toward the direction of the platen roller 20. The letter-V spring 30, when installed in the printer apparatus as illustrated in FIG. 3, exerts a restoring force in the direction indicated by arrows in FIG. 3. Specifically, the restoring force acts in such a direction as to narrow the letter-V shape in the state illustrated in FIG. 3. Namely, the letter-V spring 30 is installed such that the restoring force serves to bring the first part 31 and the second part 32 of the letter-V spring 30 closer to each other. The head contact 33 is formed by bending the end of the second part 32 of the letter-V spring 30 into an arc shape.

The printer apparatus of the present embodiment utilizes the letter-V spring 30 as described above to press the thermal head 10 against the platen roller 20. Even in the case of the frame being made of resin material, the frame does not deform because the above-noted configuration ensures that the force of the letter-V spring 30 is not applied to the wall of the frame extending in the width direction. It is thus safe to make the frame by use of resin material. Further, there is no need to provide a frame for supporting the letter-V spring 30, which enables the size reduction of the printer apparatus as well as cost reduction.

Figure 4A:
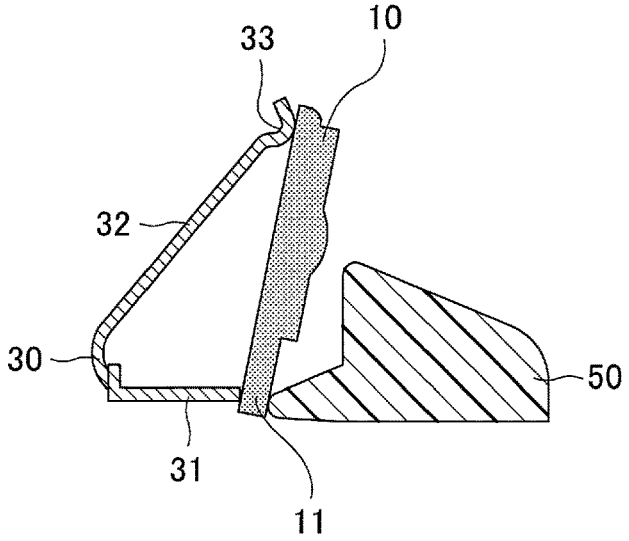
FIG. 4A is a drawing illustrating the printer apparatus of the first embodiment.
Figure 4B:
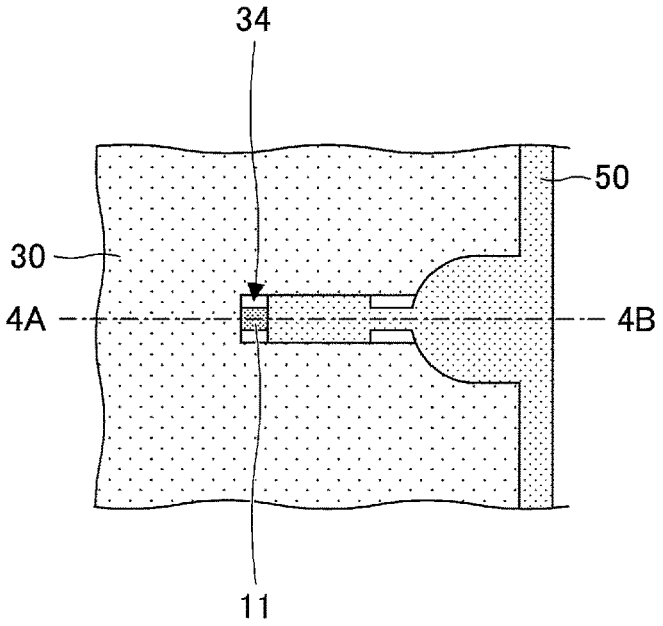
FIG. 4B is a drawing illustrating the printer apparatus of the first embodiment.

As illustrated in FIGS. 4A and 4B, a projection 11 formed at an end of the thermal head 10 opposite from the side of the thermal head 10 for printing on printing paper (not shown) is inserted into a groove 34 formed in the first part 31 of the letter-V spring 30. The projection 11 is wedged between the first part 31 of the letter-V spring 30 and the recording paper guide 50 made of resin material. The projection 11 of the thermal head 10 serves as a rotation axis of the thermal head when the letter-V spring 30 presses the thermal head 10 toward the platen roller 20. FIG. 4B is a bottom view. FIG. 4A is a cross-sectional view taken along a dot-and-dash line 4A-4B in FIG. 4B. It may be noted that FIG. 4A shows a cross-sectional view taken at a different cross-sectional position than in FIG. 3.

Figure 5:
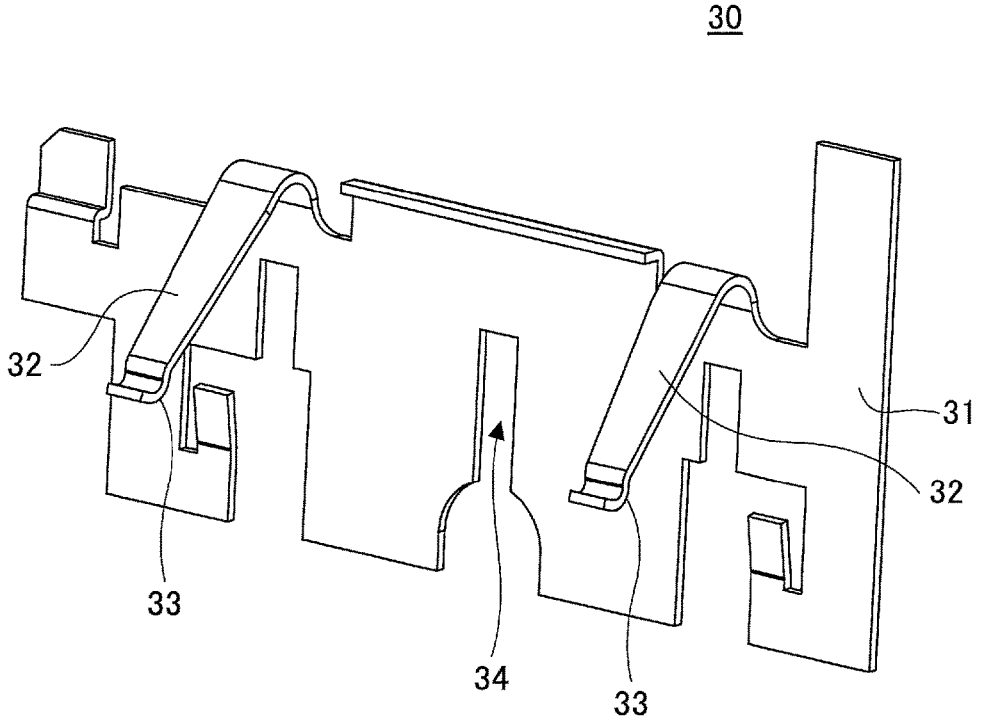
FIG. 5 is an axonometric view of a letter-V spring.

In the following, the letter-V spring 30 will be described in more detail with reference to FIG. 5. The letter-V spring 30 in FIG. 5 is of a leaf-spring type. The letter-V spring 30 has the first part 31 and the second part 32, which are parts of a single seamless, continuous metal plate. The portion of the metal plate that serves as the second part 32 is bent relative to the portion of the metal plate serving as the first part 31. More than one second part 32 may be formed as part of the letter-V spring 30 in order to apply uniform pressure to the thermal head 10. The end of the second part 32 has the head contact 33 that comes in contact with the thermal head 10 for the purpose of applying a force to the thermal head 10. The first part 31 has a wide flat shape for serving as part of a frame, a center part of which has the groove 34 into which the projection 11 of the thermal head 10 is inserted. The projection 11 of the thermal head 10 is wedged between the letter-V spring 30 and the recording paper guide 50 in the groove 34 of the first part 31 of the letter-V spring 30 such as to be rotatable. With this arrangement, the thermal head 10 is able to rotate around the projection 11 serving as a rotation axis.

The letter-V spring 30 is made of metal material such as stainless, and thus has the function to release heat generated by a conveyance motor 60 or the like, which will be described later. The letter-V spring 30 can also serve as part of the ground due to its high electrical conductivity. Further, the letter-V spring 30 has high strength, so that the first part 31 of the letter-V spring 30 may also constitute part of the housing of the printer apparatus.

Figure 6:
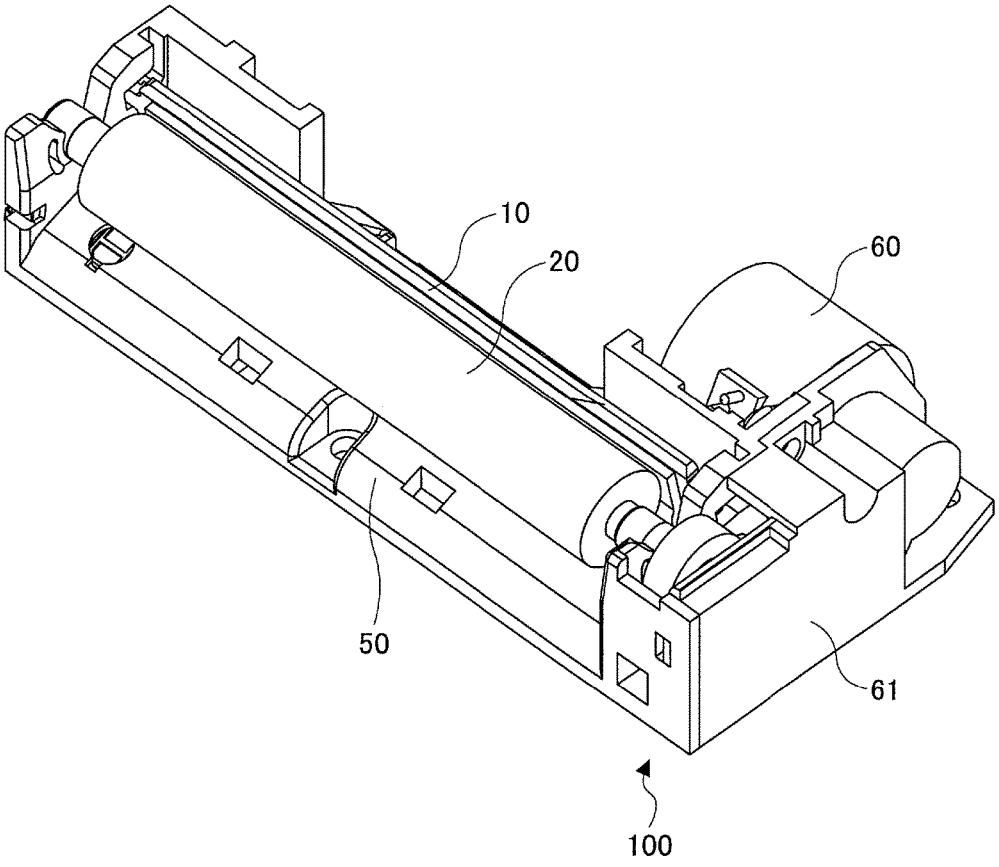
FIG. 6 is an axonometric view of the printer apparatus of the first embodiment.
Figure 7:
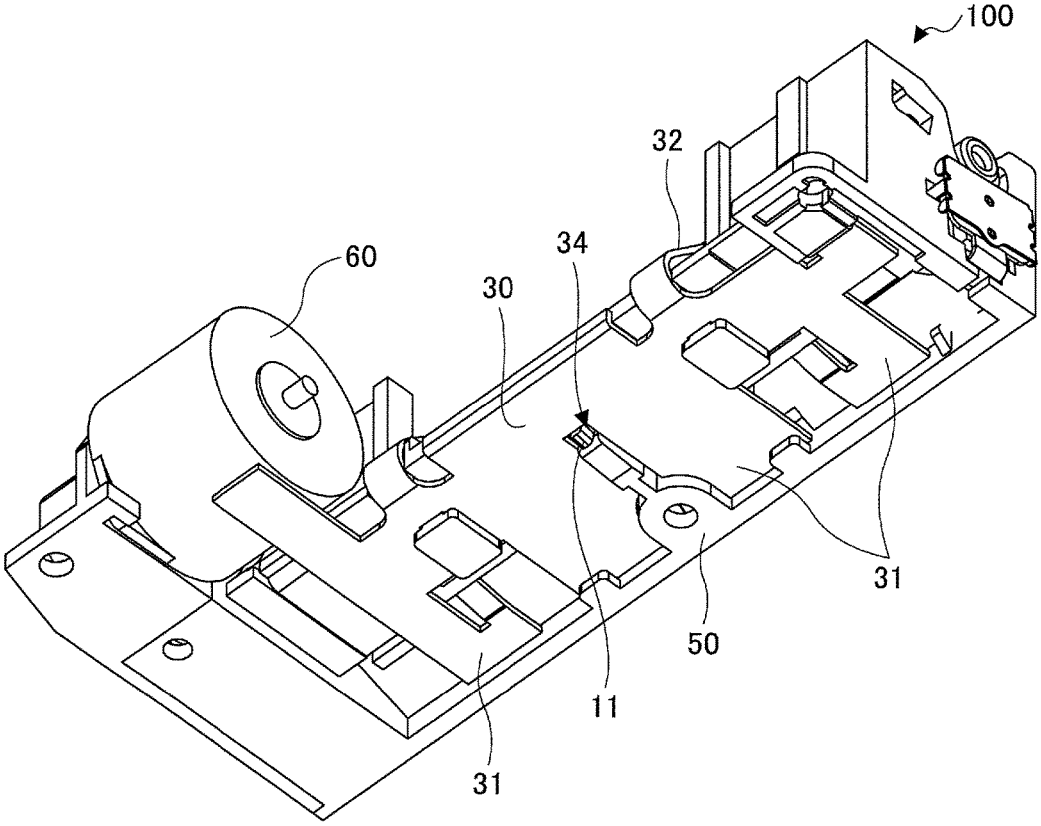
FIG. 7 is another axonometric view of the printer apparatus of the first embodiment.

FIG. 6 and FIG. 7 are axonometric views of the printer apparatus of the present embodiment. The printer apparatus of the present embodiment includes the conveyance motor 60 for rotating the platen roller 20 and a gear box 61 for transmitting the rotation of the conveyance motor 60 to the platen roller 20. The platen roller 20 is axially supported by a frame 100 in a rotatable manner. The conveyance motor 60, the gear box 61, etc. are disposed on the frame 100. The frame 100 of the present embodiment may be made of resin. The recording paper guide 50 is formed seamlessly with the frame 100.

FIG. 7 is an axonometric view of the printer apparatus of the present embodiment with the bottom face thereof being illustrated. The frame 100 has the letter-V spring 30 mounted thereon. A portion of the recording paper guide 50 is inserted into the groove 34. The projection 11 is wedged between, and supported by, the groove 34 and the portion of the recording paper guide 50. The first part 31 of the letter-V spring 30 covers part of the frame 100 of the printer apparatus made of resin material or the like. The head contact 33 of the second part 32 presses the thermal head 10. Accordingly, unlike the configuration illustrated in FIG. 1, the restoring force of the letter-V spring 30 does not damage the frame.

Second Embodiment

In the following, a second embodiment will be described. The present embodiment is directed to the structure in which the first part 31 of the letter-V spring 30 has a sensor contact 35 as illustrated in FIG. 8.

Figure 8:
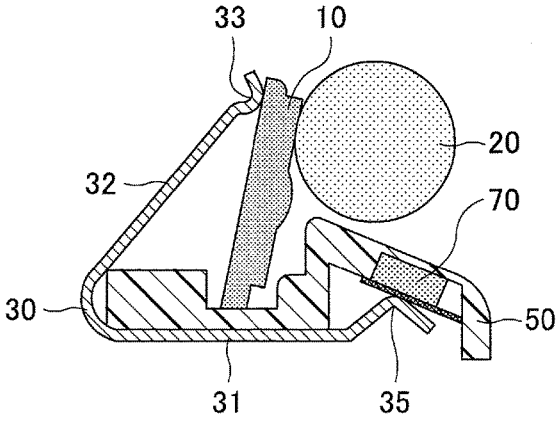
FIG. 8 is a drawing illustrating the printer apparatus of a second embodiment.

The printer apparatus illustrated in FIG. 8 has a recording paper sensor 70 in the recording paper guide 50 for detecting whether recording paper (not shown) is present. The recording paper sensor 70 is an optical sensor. In the present embodiment, the recording paper sensor 70 is disposed in a recess formed in the recording paper guide 50 made of resin. The first part 31 of the letter-V spring has the sensor contact 35 formed near the end thereof, and the sensor contact 35 is in contact with and pressed against the back face of the recording paper sensor 70. Pressing the sensor contact 35 against the recording paper sensor 70 ensures that the recording paper sensor 70 is secured at a predetermined position. The sensor contact 35 is formed by bending the end of the first part 31 of the letter-V spring 30.

Further, although a description has been given with respect to one or more embodiments of the present invention, the contents of such a description do not limit the scope of the invention.

The present application claims foreign priority to Japanese priority application No. 2014-113249 filed on May 30, 2014 with the Japanese Patent Office, the entire contents of which are hereby incorporated by reference.

DESCRIPTION OF REFERENCE SYMBOLS

10 thermal head
11 rotational projection
20 platen roller
30 letter-V spring
31 first part
32 second part
33 head contact
34 groove
35 sensor contact
50 recording paper guide
60 conveyance motor
61 gear box
70 recording paper sensor

The invention claimed is:

1. A printer apparatus, comprising:
a print head;
a platen roller;
a recording paper guide configured to guide recording paper placed between the print head and the platen roller; and
a spring configured to press the print head toward a direction of the platen roller,
wherein the spring has a first part and a second part, the first part being in contact with, and fixedly mounted to, a bottom face of the recording paper guide, the second part having a head contact at an end thereof that is in contact with the print head, the spring exerting a restoring force in such a direction as to narrow a space between the first part and the second part.

2. The printer apparatus as claimed in claim 1, wherein a plurality of said head contacts are provided.

3. The printer apparatus as claimed in claim 1, wherein the spring is made of a single metal plate.

4. The printer apparatus as claimed in claim 1, wherein the print head has a projection on a side thereof opposite from a side that is in contact with the platen roller, the projection is wedged between the first part of the spring and the recording paper guide in a rotatable manner.

5. A printer apparatus, comprising:
a print head;
a platen roller;
a recording paper guide configured to guide recording paper placed between the print head and the platen roller; and
a spring configured to press the print head toward a direction of the platen roller,
wherein the spring has a first part and a second part, the first part being in contact with the recording paper guide, the second part having a head contact at an end thereof that is in contact with the print head, the spring exerting a restoring force in such a direction as to narrow a space between the first part and the second part, and
wherein a recording paper sensor is disposed in the recording paper guide to detect the recording paper, and the recording paper sensor is placed between the recording paper guide and the first part of the spring, the recording paper sensor being pressed toward the recording paper guide by the spring.

6. A printer apparatus, comprising:
a frame;
a recording paper guide continuous with the frame;
a platen roller supported by the frame in a rotatable manner;
a print head; and
a spring having a first part and a second part, and configured to press the print head against the platen roller,
wherein the first part of the spring presses the print head, and the second part of the spring is in contact with, and fixedly mounted to, a bottom surface of the recording paper guide so as to be fixedly positioned with respect to the frame, the print head being pressed against the platen roller by a restoring force of the spring acting in such a direction as to narrow a space between the first part and the second part.

7. The printer apparatus as claimed in claim 6, wherein the spring is made of a single metal plate, and the metal plate is bent at a border between the first part and the second part.

8. The printer apparatus as claimed in claim 1, wherein the print head has a projection on a side thereof opposite from a side that is in contact with the platen roller, and the first part of the spring has a groove formed therein, the projection being placed in the groove of the first part of the spring and wedged between an end of the groove of the first part of the spring and the recording paper guide in a rotatable manner.

* * * * *